US007988138B2

(12) United States Patent
Brünner et al.

(10) Patent No.: US 7,988,138 B2
(45) Date of Patent: Aug. 2, 2011

(54) GATHERER STITCHER WITH VARIABLE CHAIN PITCH

(75) Inventors: Torsten Brünner, Borsdorf (DE); Frank Jaentschel, Leipzig (DE); Torsten Krause, Calden (DE); Andreas Steinert, Beucha (DE); Siegmar Tischer, Borsdorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 140 days.

(21) Appl. No.: 12/467,328

(22) Filed: May 18, 2009

(65) Prior Publication Data

US 2010/0156021 A1 Jun. 24, 2010

(30) Foreign Application Priority Data

May 16, 2008 (DE) ..... 10 2008 023 865

(51) Int. Cl.
*B42B 2/02* (2006.01)

(52) U.S. Cl. ..... 270/52.18; 227/100; 227/102

(58) Field of Classification Search ..... 270/52.18; 227/100, 101, 102
See application file for complete search history.

(56) References Cited

U.S. PATENT DOCUMENTS 4,614,290 A * 9/1986 Boss ..... 227/1
5,174,557 A * 12/1992 Meier ..... 270/38
6,142,353 A * 11/2000 Boss et al. ..... 227/44
6,142,354 A * 11/2000 Boss et al. ..... 227/100
6,899,325 B2 * 5/2005 Steinert et al. ..... 270/52.18
7,404,550 B2 * 7/2008 Vogel et al. ..... 270/52.18
7,451,969 B2 * 11/2008 Bottcher et al. ..... 270/52.14
7,628,389 B2 * 12/2009 Steinert et al. ..... 270/52.26
2005/0248076 A1 * 11/2005 Bottcher et al. ..... 270/52.18

FOREIGN PATENT DOCUMENTS

DE 34 43 376 A1 8/1985
EP 0 956 974 A1 11/1999
EP 0 958 942 A1 11/1999

OTHER PUBLICATIONS

German Patent and Trademark Office Search Report, dated Jan. 28, 2009.

* cited by examiner

*Primary Examiner* — Patrick Mackey
(74) *Attorney, Agent, or Firm* — Laurence A. Greenberg; Werner H. Stemer; Ralph E. Locher

(57) ABSTRACT

A gatherer stitcher for collating signatures made of paper, paperboard and the like, for stitching the collated signatures and for delivering the stitched signatures, includes a gathering section, a stitching station and a delivery station. The stitching station has a stitching carriage with at least one stitching head and, during a stitching operation, the stitching carriage is moved by a stitching carriage drive at a speed of the collated signatures. A switching unit is disposed between the stitching carriage drive and the stitching carriage for adapting a stitching carriage movement to a gatherer chain pitch, that is to say for adapting a horizontal reciprocating movement of the stitching carriage, and for adapting a horizontal distance between the stitching carriage and the delivery station.

9 Claims, 3 Drawing Sheets

GATHERER STITCHER WITH VARIABLE CHAIN PITCH

CROSS-REFERENCE TO RELATED APPLICATION

This application claims the priority, under 35 U.S.C. §119, of German Patent Application DE 10 2008 023 865.1, filed May 16, 2008; the prior application is herewith incorporated by reference in its entirety.

BACKGROUND OF THE INVENTION

Field of the Invention

The invention relates to a gatherer stitcher for collating signatures made of paper, paperboard and the like, for stitching the collated signatures and for delivering the stitched signatures. The gatherer stitcher includes a gathering section, a stitching station and a delivery station. The stitching station has a stitching carriage with at least one stitching head and, during the stitching operation, the stitching carriage is moved by a stitching carriage drive at the speed of the collated signatures.

Generic gatherer stitchers are known. Individual folded sheets from a stack are separated, opened and deposited on a gatherer chain from folded sheet feeders. The gatherer chain has a guide device with an upper section which is formed like a cutter and a ridge line of which defines a transport and stitching line, and a substantially roof-like support, on which the folded sheets are transported astride. The gatherer chain has driver elements which convey the deposited folded sheets in the horizontal direction in order to grip the folded sheets deposited on the gatherer chains securely even at high processing speed, to achieve reliable driving and to transport them uniformly. The folded sheets conveyed by the gatherer chain and drivers are transported by the gatherer chain as far as a stitching station, in which folded sheets lying on one another are stitched in the fold with the aid of wire staples. To this end, use is made of stitching heads disposed above the gatherer chain and clinching boxes disposed underneath the gatherer chain, which bend over free ends of wire staples stuck through the folded sheets by the stitching heads. After that, the stitched, folded sheets are conveyed onward by the gatherer chain in a deliverer region for further processing. For example, edge trimming and delivery follow.

The productivity of a gatherer stitcher depends not only on the operating speed but instead also on how many products can be processed by the machine in a specific time. In order to increase the number of products per unit time and therefore the productivity of the gatherer stitcher without increasing the speed of the gatherer chain, the chain pitch is adapted to the product format, which is to say the distance between the drivers on the gatherer chain is changed. Since, in the case of smaller products, a shorter distance between the drivers on the gatherer chain is sufficient, more products can be deposited on the gatherer chain per unit time as a result of an appropriate reduction in that distance, which increases the productivity.

Various approaches to a device for changing the chain pitch are known from the prior art. For example, driver elements can be fitted to outer plates of roller chains, for example by screwing, and simply removed again. Alternatively, driver elements can be fitted to outer plates of the roller chain without tools through the use of clamp connections.

In a further variant, the driver elements can be configured as plastic pins which are plugged into saddle segments of the gatherer chain that are provided with driver holes.

The problem with those approaches to a device is that the manual changing of the chain pitch is complicated and time-consuming. The necessary stoppage times in order to adapt the machine to the product format again cause lower productivity.

German Published, Non-Prosecuted Patent Application DE 10 2006 057 681, corresponding to U.S. Patent Application Publication No. US 200810136082A1, shows a gatherer stitcher having an endless gatherer chain for the gathering and transport of folded sheets astride. The gatherer chain has chain roof segments and driver elements and the position of the driver element is adjustable. In an inactive position, the folding driver element forms part of the roof of the gatherer chain and, in another, active position, projects out of the roof of the gatherer chain, transversely with respect to the conveying direction. The driver element can be activated through the use of a control device. The chain pitch of the gatherer chain can be adapted quickly and simply to various product formats to be processed by folding the driver elements out and in.

In such a gatherer stitcher, the speed profile of the stitching device must be adapted to the gatherer chain pitch. The associated conversion effort is time-consuming and therefore disadvantageous.

SUMMARY OF THE INVENTION

It is accordingly an object of the invention to provide a gatherer stitcher with variable chain pitch, which overcomes the hereinafore-mentioned disadvantages of the heretofore-known devices of this general type and in which an adaptation of a speed profile of a stitching device to a gatherer chain pitch can be carried out simply.

In the gatherer stitcher according to the invention, it is advantageously ensured that the collated signatures are stitched centrally without adjusting the at least one stitching head, and the stitched brochures are delivered centrally in the delivery station.

With the foregoing and other objects in view there is provided, in accordance with the invention, a gatherer stitcher for collating signatures made of paper, paperboard and the like, for stitching the collated signatures and for delivering the stitched signatures. The gatherer stitcher comprises a gathering section, a stitching station and a delivery station. The stitching station has a stitching carriage with at least one stitching head and, during a stitching operation, the stitching carriage is moved by a stitching carriage drive approximately at the speed of the collated signatures. The gathering section includes a transport unit moved by a drive, such as a gatherer chain, to transport the signatures. A switching unit is advantageously disposed between the stitching carriage drive and the stitching carriage to adapt a stitching carriage movement to the distance from collated signatures running into the stitching station to collated signatures subsequently running in, which is to say to adapt to the gatherer chain pitch, and to adapt the position of the stitching carriage relative to the delivery station, which is to say to adapt the horizontal distance from the center of the stitching carriage to the center of the delivery station. Through the use of such a gatherer stitcher, it is advantageously ensured that the gatherer stitcher and its stitching station can be adapted to various gatherer chain pitches simply and without additional conversion operations. Therefore, a large format range can be processed with ideally high cycle rates.

In accordance with another feature of the invention, the switching unit is formed by a link mechanism having a displaceable coupling point. In a particularly advantageous embodiment, the switching unit includes a swinging arm, which is connected through a drive link to the stitching carriage drive and through a driven link to the stitching carriage. The drive link and the swinging arm are connected to each other at a first coupling point. The driven link and the swinging arm are in turn connected to each other at a second coupling point. The position of one of the two coupling points on the swinging arm can be varied, in particular displaced, and that coupling point is used to adapt the switching unit to the product format.

In accordance with a further feature of the invention, the change in the position of the at least one coupling point is carried out by an actuator. The actuator can advantageously be a pneumatic cylinder. The adjustment can also be carried out by an electric motor device, for example through a motor and spindle, or else hydraulically. It is particularly advantageous if the actuator is connected to a control system of the gatherer stitcher and is activated by the former. The setting of the switching unit and the adaptation of the gatherer stitcher to the gatherer chain pitch can therefore be carried out automatically in a simple way.

In accordance with a concomitant feature of the invention, in a first advantageous development of the gatherer stitcher, the delivery station has an ejector carriage with an ejector to deliver the stitched signatures, the ejector carriage being moved during the delivery operation by an ejector carriage drive, approximately at the speed of the stitched signatures, and the ejector carriage drive and the stitching carriage drive being coupled mechanically to each other. In a second advantageous development of the invention, the ejector carriage drive and the stitching carriage drive are not coupled to each other mechanically but through a virtual shaft. The stitching carriage drive and/or the ejector carriage drive can advantageously include a controllable electric motor.

Other features which are considered as characteristic for the invention are set forth in the appended claims.

Although the invention is illustrated and described herein as embodied in a gatherer stitcher with variable chain pitch, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
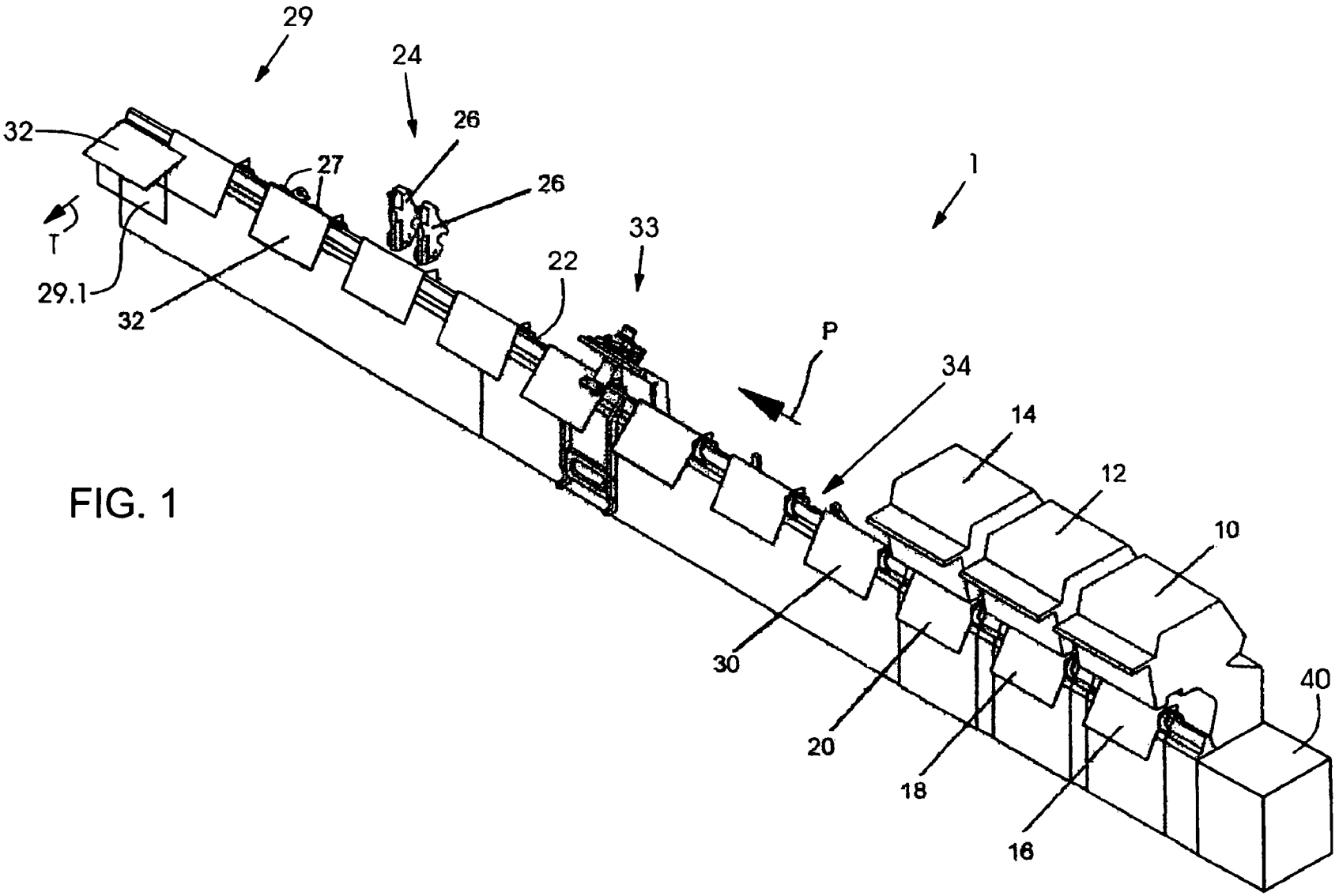
FIG. 1 is a simplified, diagrammatic, perspective view of an exemplary embodiment of a gatherer stitcher for brochures, having feeders, a stitching station and a subsequent delivery station and also having a non-illustrated transport device which conveys signatures deposited by the feeders to the stitching station and then to the delivery station.

Referring now to the figures of the drawings in detail and first, particularly, to FIG. 1 thereof, there is seen an exemplary embodiment of a gatherer stitcher 1 having machine components including three feeders 10, 12, 14, which respectively transfer signatures 16, 18, 20 to a diagrammatically-illustrated continuous conveyor 34. The signatures 16, 18, 20, which are deposited and laid above one another in this way, together form collated signatures 30 which, like brochures formed previously, are transported in a transport direction according to an arrow P along a transport and stitching line 22, which extends along the feeders 10, 12, 14 and beyond a stitching station 24 as far as a delivery station 29. In the present exemplary embodiment, the stitching station 24 includes two stitching heads 26 and a respective crimper associated with the same but not visible in FIG. 1, which bend over wire staples 27 stuck into brochures 32 to be stitched through the use of the stitching heads 26, specifically legs of the wire staples 27 which have penetrated the collated signatures 30.

The crimpers, together with the stitching heads 26 and non-illustrated devices for the production of the wire staples 27, form a machine component in the form of a stitching machine.

In the present exemplary embodiment, the delivery station 29 includes a machine component in the form of a non-illustrated ejector. The ejector engages in a respective fold of the stitched brochure 32 and lifts the latter out of the transport and stitching line 22 in order to permit the brochure to be transported onward in the direction of an arrow T, specifically preferably in the direction of a trimming apparatus.

A measuring station 33, in which the thickness of the collated signatures 30 to be stitched is determined, is provided upstream of the stitching station 24 with respect to the transport in the direction of the arrow P.

Figure 2A:
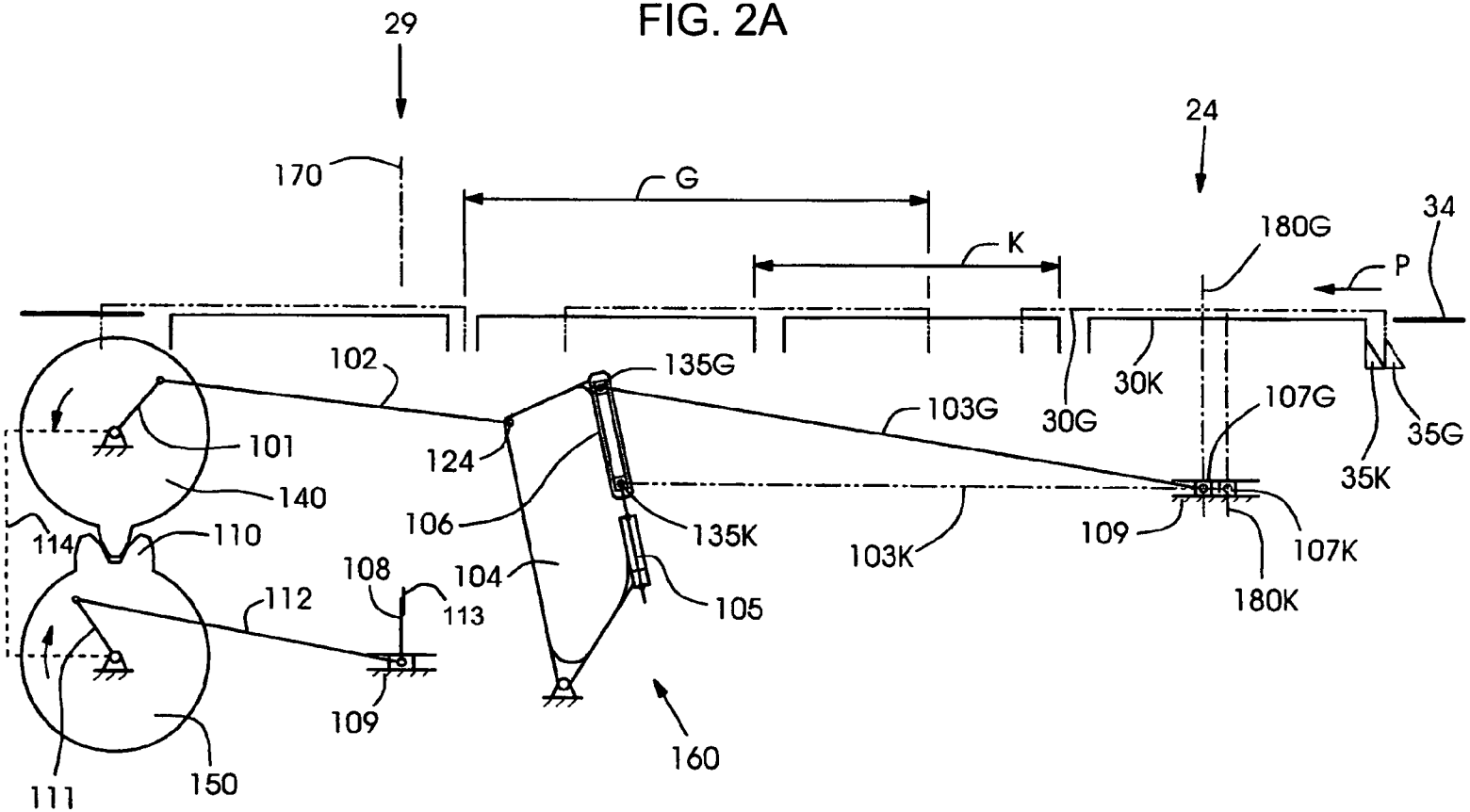
FIG. 2A is a schematic and graphic illustration of a principle of a switching unit in a first position during acceptance and stitching.
Figure 2B:
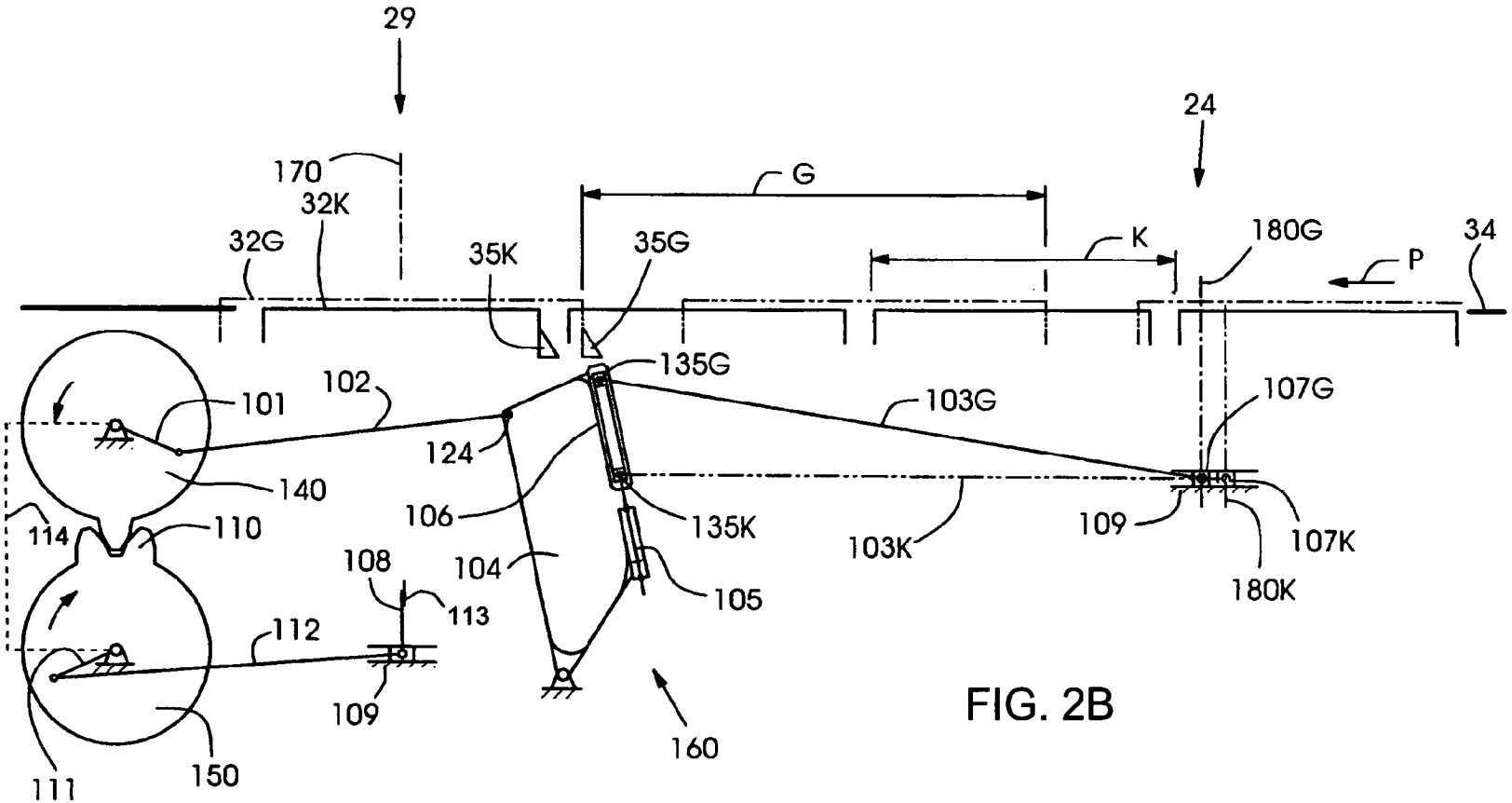
FIG. 2B is an illustration similar to FIG. 2A of the principle of the switching unit in a second position during delivery.

The continuous conveyor 34 in the present exemplary embodiment represents a gathering section and is constructed as an endless gatherer chain which circulates during operation and on which drivers 35, shown in FIGS. 2A and 2B, are disposed. The drivers 35 push these signatures 16, 18, 20 in front of them, transferred astride to the gatherer chain and, ultimately, the collated signatures 30 to be stitched.

FIGS. 2A and 2B show a drive of an ejector carriage 108 and of a stitching carriage 107 for a large or alternatively for a small product format. The drive is illustrated in each case for collated signatures of large product format 30G, which are illustrated by a dash-dotted line, and of small product format 30K, which are illustrated by a continuous line. The signatures 30 are transported by the continuous conveyor 34, for example a gatherer chain, in the transport direction P through the stitching station 24 to the delivery station 29.

The large format products can, for example, be products in the A3 format and the small format products can, for example, be products in the A4 format.

A situation during the acceptance of the signatures 30 to be stitched and the following stitching in the stitching station 24 is illustrated in FIG. 2A. A collated signature of large product format 30G is shown, which is guided by a driver 35G and is processed by a non-illustrated stitching head of a stitching carriage 107G. Likewise shown is a collated signature of small product format 30K, which is guided by a driver 35K and is processed by a non-illustrated stitching head of a stitching carriage 107K. During the stitching operation, the stitching carriage 107 is moved vertically, approximately at the speed of the signatures 30 to be stitched.

A situation during the delivery of the stitched brochure in the delivery station 29 is illustrated in FIG. 2B. FIG. 2B shows a stitched brochure of large product format 32G, which is resting on a driver 35G, and also a stitched brochure of small product format 32K, which is resting on a driver 35K.

Stitched brochures 32G and 32K are delivered by an ejector 113 fitted to the ejector carriage 108. The center of the ejector carriage assumes the position of the center 170 of the delivery station 29, which coincides with the center of the stitched brochures 32, irrespective of whether a large product format 32G or a small product format 32K is involved.

As is shown in FIGS. 2A and 2B, a switching unit 160 is disposed between a stitching carriage drive 140 and the stitching carriage 107 in order to adapt and optimize a stitching carriage movement to a gatherer chain pitch G, K, which is to say to adapt a horizontal reciprocating movement of the stitching carriage 107 and to adapt a horizontal distance between the stitching carriage 107 and the delivery station 29.

The stitching carriage 107 is guided by a linear guide 109 and, during the stitching operation, is moved in a horizontal plane at approximately the speed of the signature 30. The stitching carriage 107 is driven by the stitching carriage drive 140. The ejector carriage 108 is also guided by a linear guide 109 and, during the ejection operation, is moved approximately at the speed of the stitched brochures 32. The ejector carriage 108 is driven by an ejector carriage drive 150.

The stitching carriage drive 140 and the ejector carriage drive 150 are coupled to each other mechanically by a gear 110. In an alternative embodiment illustrated by dashed lines, the two drives 150, 140 could also be coupled to each other through an electronic shaft 114.

The gatherer chain 34 has the drivers 35 which are used to transport the collated signatures 30. In order to provide an adaptation to the product format of the signatures 30 to be processed, the position of the drivers 35 on the gatherer chain 34 can be adapted. The drivers 35G for collated signatures of large product format 30G are located at a different position than the drivers 35K for signatures of small product format 30K. Therefore, the gatherer chain 34 can be set to the large chain pitch G for large product format and the small chain pitch K for small product format.

In order to guarantee central stitching in the stitching station 24 and central delivery in the delivery station 29, firstly the length of the horizontal reciprocating movement of the stitching carriage 107 and the horizontal distance from the stitching carriage 107 to the center of the delivery station 29 must be adapted. This is done by the switching unit 160 as follows:

The stitching carriage drive 140 includes a crank 101, to which a first end of a drive link 102 is fixed in such a way that it can rotate. A second end of the drive link 102 is connected to a swinging arm 104. The swinging arm 104 includes a guide 106, in which a coupling element for coupling a first end of a drive link 103 can be displaced. The drive link 103 has a second end connected to the stitching carriage 107 and effects the horizontal reciprocating movement of the latter. In order to adapt the switching unit 160 to large product formats, a coupling point 135G is moved to an upper end of the guide 106 by an actuator 105, such as a pneumatic cylinder. In order to adapt the switching unit 160 to a small product format, a coupling point 135K is moved as far as a lower end of the guide 106 by the actuator 105. Through the use of this adaptation, firstly the size of the vertical reciprocating movement of the stitching carriage 107 and a position of a stitching carriage center 180 are adapted to the chain pitch. The stitching carriage center is located at a position 180G for the large chain pitch G for large product format. The stitching carriage center is located at a position 180K for the chain pitch for small product format. Through the use of this adjustment, the horizontal distance between the stitching carriage center 180 and the center of the delivery station 29 are adapted, as illustrated by the line 170. Additional mechanical setup operations, such as repositioning of the crank radius, positioning of the stitching heads etc., are therefore dispensed with.

The invention claimed is:

1. A gatherer stitcher for collating signatures made of paper or paperboard, for stitching the collated signatures and for delivering the stitched signatures, the gatherer stitcher comprising:

a gathering section, a stitching station and a delivery station;

said stitching station having a stitching carriage with at least one stitching head;

a stitching carriage drive moving said stitching carriage at a speed of collated signatures during a stitching operation; and a switching unit disposed between said stitching carriage drive and said stitching carriage for adapting a movement of said stitching carriage to a distance between collated signatures running into said stitching station and collated signatures subsequently running in, and for adapting a position of said stitching carriage relative to said delivery station.

2. The gatherer stitcher according to claim 1, wherein said switching unit includes a link mechanism having a displaceable coupling point.

3. The gatherer stitcher according to claim 2, wherein:

said switching unit includes a swinging arm, a drive link connected between said swinging arm and said stitching carriage drive, and a driven link connected between said swinging arm and said stitching carriage;

said drive link and said swinging arm are connected to each other at a first coupling point;

said driven link and said swinging arm are connected to each other at a second coupling point; and at least one of said coupling points is disposed at a variable position on said swinging arm.

4. The gatherer stitcher according to claim 3, which further comprises an actuator for carrying out a change in said position of said at least one coupling point.

5. The gatherer stitcher according to claim 4, wherein said actuator is a pneumatic cylinder.

6. The gatherer stitcher according to claim 4, wherein said actuator is connected to and activated by a control system of the gatherer stitcher.

7. The gatherer stitcher according to claim 1, wherein said delivery station has an ejector carriage with an ejector for delivering stitched signatures and an ejector carriage drive for moving said ejector carriage during a delivery operation at a speed of the stitched signatures, said ejector carriage drive and said stitching carriage drive being coupled mechanically to each other.

8. The gatherer stitcher according to claim 1, wherein said delivery station has an ejector carriage with an ejector for delivering stitched signatures and an ejector carriage drive for moving said ejector carriage during a delivery operation at a speed of the stitched signatures, and a virtual shaft couples said ejector carriage drive and said stitching carriage drive to each other.

9. The gatherer stitcher according to claim 1, wherein said stitching carriage drive includes a controllable electric motor.

* * * * *